United States Patent [19]

Haissig

[11] Patent Number: 4,580,614

[45] Date of Patent: Apr. 8, 1986

[54] COOLING APPARATUS FOR HORIZONTAL CONTINUOUS CASTING OF METALS AND ALLOYS, PARTICULARLY STEELS

[75] Inventor: Manfred Haissig, Irvine, Calif.

[73] Assignee: Vereinigte Edelstahlwerke Aktiengesellschaft, Vienna, Austria

[21] Appl. No.: 462,189

[22] Filed: Jan. 31, 1983

[51] Int. Cl.[4] ..... B22D 11/22

[52] U.S. Cl. ..... 164/154; 164/414; 164/443; 164/455

[58] Field of Search ..... 164/414, 443, 440, 455, 164/485, 154

[56] References Cited

U.S. PATENT DOCUMENTS

| | | | |
|---|---|---|---|
| 3,467,168 | 9/1969 | Charman, Jr. | 164/440 X |
| 3,886,991 | 6/1975 | Meier et al. | 164/414 X |
| 4,047,985 | 9/1977 | Greenberger | 164/414 X |

FOREIGN PATENT DOCUMENTS

| | | | |
|---|---|---|---|
| 303987 | 12/1972 | Austria . | |
| 26487 | 9/1980 | European Pat. Off. . | |
| 26390 | 9/1980 | European Pat. Off. . | |
| 1932884 | 1/1970 | Fed. Rep. of Germany . | |
| 2415224 | 10/1974 | Fed. Rep. of Germany . | |
| 559074 | 2/1975 | Switzerland | 164/440 |

*Primary Examiner*—Nicholas P. Godici

*Assistant Examiner*—J. Reed Batten, Jr.

*Attorney, Agent, or Firm*—Brumbaugh, Graves, Donohue & Raymond

[57] ABSTRACT

An aftercooler for a horizontal continuous casting system is comprised of a plurality of individual cooling elements adapted to be positioned in contact with the strand after it leaves the mold. Each of the cooling elements has a passage for the flow of a fluid cooling medium through it and either or both of the contact pressure of the element against the strand and the flow rate of cooling medium may be adjusted to control the rate of cooling to suit the solidification characteristics of the metal being cast. Preferably, a plurality of sets of cooling elements are sequentially disposed along the length of the strand immediately downstream of the mold, each of the sets being disposed circumferentially around the strand so as to cool it on all sides. Control of the contact pressure and cooling medium flow rate is effected by a computer which compares measured values of cooling medium temperatures and flow rates in the elements with stored data representing desired characteristics for the metal being cast. The computer controls D.C. stepping motors to adjust the contact pressure and valves to vary the flow rate to maintain the measured values substantially the same as the stored values.

10 Claims, 10 Drawing Figures

COOLING APPARATUS FOR HORIZONTAL CONTINUOUS CASTING OF METALS AND ALLOYS, PARTICULARLY STEELS

BACKGROUND OF THE INVENTION

This invention relates to cooling apparatus for horizontal continuous casting of metals and alloys, particularly steels, and more specifically to aftercoolers for such systems.

In horizontal continuous casting systems, the molten metal coming out of the melt distributor is poured into a horizontal continuous casting ingot mold made of a heat-conductive metal and customarily cooled with a cooling medium. In the mold, upon profiling, the metal strand being formed begins to solidify and to consolidate starting from its outer surface and progressing inwardly. The solid strand shell formed during this process increases in thickness during its passage through the ingot mold. However, at the point of leaving the ingot mold, the shell is still relatively thin, in the case of metals and alloys customarily cast in such systems. The drawn off strand thus is not yet sufficiently mechanically sturdy for handling such as, for instance, for drawing off out of the ingot mold.

Consequently, downstream of the ingot mold in the direction of travel of the strand, there is generally arranged one or more aftercoolers in which a thickening or reinforcement of the strand shell is obtained, increasing the strength of the strand so that the strand, which in its center is still molten, can, without risk of breakage, be picked up by the strand withdrawal device, for instance by its driving rollers, and can thereafter be handled further as desired.

To stabilize the strength of the strand as rapidly as possible after its shaping, an important factor is to insure that the cooling within the ingot mold is uniform about the circumference of the strand. From experience gained in the continuous steel casting of billets and blooms, it is known to increase the heat dissipation by means of a universal conical design of the ingot mold cavity, tapered in the longitudinal direction of the strand, which promotes growth of the shell. It has also been described in the literature how to determine the degree of taper of the ingot mold with respect to the shrinkage of the metal in order to achieve the positive effects of improved heat dissipation and shell growth, accompanied at the same time by reduced ingot mold friction. Any initially optimally set ingot mold geometry undergoes changes during operation as a result of wear and/or warping, so that, for instance, the predetermined conicity is lost or there occurs possibly even a reverse conicity. Such an unfavorable ingot mold geometry may then result in damage to the cast strand, e.g., cracks or breaks.

It is also known that in determining the conicity of the ingot mold, the carbon percentage of the steel being cast and the differences arising therefrom with regard to dissipation of heat and ingot mold friction are to be taken into consideration.

In order to avoid damage as a result of wear and/or warping of the ingot mold it is customary in practice to check the ingot mold geometry by means of gauges during plant idle periods, which involves the performing of costly measurements.

In European Patent Application No. 26,487, there is described a process for the monitoring of the ingot mold status while casting operations are in progress, which makes it possible to recognize early any undesirable changes in ingot mold geometry and to prevent thereby the above described impairment of the strand, such as, e.g., cracks or breaks.

In that process, the actual value of the cooling capacity of the ingot mold is determined and compared with a theoretical value predetermined as a function of the carbon percentage and the residence time of the cast steel in the ingot mold. An excessive deviation of the actual value from this theoretical value indicates a potential damaging alteration of the ingot mold geometry. Appropriate measures are then taken to guarantee desired strand quality. While this known process makes it possible to recognize in advance the likelihood of damage to be suffered by the strand because of unfavorable ingot mold geometry, correction or readjustment of the ingot mold geometry during the operation is however not contemplated with that process.

European Patent Application No. 26,390 discloses a process for setting the rate of adjustment of the narrow sides of a plate-type ingot mold in the continuous casting of steel in which, for the purpose of changing the size, the spacing between the narrow sides of the mold is changed while the continuous casting operation is in progress. In order to keep the length of the transition piece of the strand, that is, the portion of the strand between the prior cast format and the format to be newly cast thereafter, and to keep material losses at a minimum, the rate of adjustment is as high as possible, which involves the risk of the occurrence of bulgings and breaks on the strand.

In that process, the amount of heat discharged during the adjustment of the cooling medium is measured at the narrow sides of the mold, and the spacing between the narrow sides is adjusted at a rate only fast enough that the amount of heat dissipated does not go below an amount predetermined in a given case.

Neither of the two last-mentioned prior art processes contemplates adjustment of the position of the sides of the ingot mold, other than its narrow sides.

German AS No. 2,415,224 discloses a process for the control of the cooling capacity, likewise only of the narrow side walls, of plate-type ingot molds during continuous casting, where the narrow side walls are clamped between the wide side walls and where, prior to the onset of casting, the mold cavity between the narrow side walls is provided with a taper converging in the direction of travel of the strand and adapted to the grade of steel and the width of the strand. Prior to the commencement of casting, the taper is adjusted additionally to a theoretical value corresponding to the predetermined casting rate and/or casting temperature, and, upon deviation of the casting rate and/or the casting temperature during casting operation, the taper is modified according to predetermined theoretical values corresponding to these changing casting parameters.

All of the known processes hitherto mentioned concern adaptation of the geometry of the casting mold to the dimensional changes in the strand that occur or that may be expected as a result of the changes in casting parameters, the grade of the metal or the alloy or, in the event of desired cross-sectional changes of the strand, where changes are made only in the position of the narrow side walls of plate-type ingot molds. These processes do not take into account the two other sides of the strand nor the dimensional changes occurring in the cast strand upon further cooling after it leaves the profiling casting mold, the resulting shrinkage phenomena, phase changes, and the like. However, these other factors have an important bearing on the strength of the finished strand and for the homogeneity and quality of the cast. It is precisely during further cooling after leaving the profiling casting mold, by means of an aftercooler or aftercoolers, that changes in the cross-section of the strand, generally reductions, occur, with the possibility of these changes in cross-section taking place nonuniformly as a result of the phase changes occurring at different temperatures. In other words, dimensional constancy can occur, for instance, in spite of cooling.

In addition to the ingot molds adapted to compensate for cross-sectional dimensional changes in the strand in one direction, aftercooling devices have become known in continuous vertical and arc casting plants in which cooling of the strand is effected by the application of a cooling medium, generally water, directly onto the strand. Austrian Pat. No. 303,987 discloses such a device where control of the amount of cooling water applied onto the strand is accomplished by means of sensors which determine the surface temperature of the strand prior to its entrance into and following its emergence from the aftercooling zone, and a central computer which processes the temperature data and controls the cooling water supply to achieve the desired cooling characteristics.

A similar device is disclosed in the German OS 1,932,884 which provides for control of different functions of a continuous arc casting plant. This device also effects control of the aftercooling device, operating likewise according to the direct cooling principle, on the amount of cooling water transmitted onto the strand. In the plant described in this German OS, control of the cooling capacity of the ingot mold, with the aid of temperature and thruput sensors that determine the amount of heat dissipated by the cooling medium, is also effected.

With the two last-described aftercooling devices, the dimensional changes in the strand do not cause any problems because of the direct application of the cooling medium onto the strand. However, direct contact between the cooling medium and the strand presents considerable drawbacks, such as evolvement of steam, nonuniform cooling and possibly reactions between the metal and the cooling medium.

SUMMARY OF THE INVENTION

It is the object of the present invention to provide cooling of a strand, after it leaves the ingot mold, that is specially attuned to the particular characteristics of the material being cast and its behavior in the casting process, without direct contact of the cooling medium with the strand.

A particular object of the invention is to provide cooling that is uniform over the circumference of the strand and to achieve a strand shell that is uniform over the circumference, thereby to achieve, as a function of the alloy to be cast, optimum stability and strength of the finished strand so that during the handling thereof, particularly during withdrawal, damage to and breaks in the strand are avoided, whereby high quality of the finished product is obtained.

The objects of the invention are achieved, in apparatus for horizontal continuous casting of metals and alloys, in particular steels, having a molten material container, a profiling horizontal sliding mold connected thereto, the mold preferably itself being cooled, at least one aftercooler and a withdrawal device for the strand, such as of the oscillating type, wherein sensors connected with a storage and control device are provided for recording the amount of heat discharged by the cooling medium, and is characterized further in that at least one aftercooler is of the plate cooler type with position-adjustable cooling elements traversed by the cooling medium. In such apparatus, the sensors preferably arranged at each cooling element for the determination of the amount of heat discharged from the cooling medium are connected with the storage and control device which is connected in turn with position adjusting means, preferably cooperating with each one of the cooling elements, adjustable by means of the control device to predetermined theoretical values to control the position and thereby the contact pressure of the cooling elements or their cooling surfaces onto the respective surfaces of the strand and with means for varying the rate of flow of the cooling medium through the cooling elements, said storage and control device being effective to control either or both of said position adjusting means and said flow rate varying means to obtain the desired cooling of the strand.

The apparatus of the invention makes it possible selectively to adjust at least the principal circumferential surfaces and preferably also at successive longitudinal sections of the withdrawn strand, the amounts of heat given off by the strand to the aftercooling device. It is thus possible to attune the cooling capacity of the individual cooling elements to one another and with respect to requirements, property, and behavior of the material cast in a given case. The invention enables one to achieve specifically controlled cooling of the strand, over its entire circumference as well as its length, thereby obtaining a thickness of the shell strand that is uniform over the circumference of the strand and is increasing uniformly and without discontinuity in the direction of travel of the strand. A strand having such a uniformly thickening strand shell can be handled without hazard and the finished strand is distinguished by high and reproducible homogeneity and quality.

Separate and individual control of the contact pressure of the individual cooling elements on the strand and the flow rate of the cooling medium passing through each cooling element makes it possible, even in the case of possible dimensional changes of the strand, e.g., warping or deflection following leaving of the ingot mold, to providing even cooling over the circumference, insuring the formation of a uniform strand shell and one that uniformly increases in thickness along its longitudinal travel.

In accordance with the invention, control of the individual cooling elements of the aftercoolers to achieve uniform heat dissipation over the circumference of the strand, is obtained as follows. In the respective inlets and outlets of the passages provided in each of cooling elements for the flow of cooling medium, temperature measurement sensors, e.g., thermocouple elements are provided, and, in addition, in the inlet or outlet, preferably of each one of the cooling elements, there is disposed a thruput measurement sensor. The measurement data obtained by these sensors from each of the cooling elements, i.e., the amount of cooling medium passing through the cooling elements per unit of time, as well as the temperature differences between the inlet and outlet of the respective elements, are fed to the central storage and control device that computes the amounts of heat, e.g., in kW hr per unit of time, dissipated by the individual cooling elements, and compares them with data representing the theoretical cooling capacity of the individual cooling elements of the aftercooling device that have been predetermined and stored with regard to each metal or alloy to be cast. Deviations between the stored and measured data actuate mechanisms which modify one or both of the contact pressures of the individual cooling elements on the strand and the quantities of the cooling medium traversing these elements per unit of time until the measured values of the cooling capacity equal the strand theoretical values for the metal being cast.

In accordance with a preferred embodiment, the storage and control devices comprise a computer or microprocessor having data and program storage capability. These computer facilities may be separate or they may be readily integrated into a larger existing system of data processing and conversion facilities usable for other purposes as well. For example, in the case of oscillating strand withdrawal, control of the cooling may be programmed according to a time function correlated with control of the withdrawal and may be combined with computer apparatus employed for the latter purpose, such as of the type described in co-pending U.S. patent application Ser. No. 319,917, filed Nov. 10, 1981, of which I am a joint applicant.

The position adjusting means for the cooling elements and the thruput control elements for the cooling medium preferably are driven by digitally controllable, stepwise operating DC motors, which enable accurate control. However, hydraulic or solenoid actuated means may be employed, if desired.

In controlling the cooling capacity of the individual cooling elements by varying the velocity of flow of the cooling medium, the driving devices, e.g., D.C. stepping motors, are coupled to thruput control elements, such as adjustable valves, slides, or the like arranged in the inlets or outlets of the cooling elements. Furthermore, although either adjustment of contact pressure of the cooling elements against the strand or variation of the flow rate of cooling medium through the element may be used separately to achieve a desired cooling rate, it is advantageous to use both techniques at the same time, so that should breakdown of one of the two systems occur, the apparatus remains capable of maintaining control of the cooling, allowing the casting operation to continue without interruption.

In a particular embodiment of the invention, the cooling elements of the aftercooling device are arranged such that those cooling elements disposed above the longitudinally extending horizontal medial plane of the strand, can be adjusted to a higher contact pressure and/or provided with a higher cooling medium velocity of flow than the cooling elements situated beneath this plane. This arrangement has the advantage of compensating for the fact that at the underside of the strand, the contact pressure of the strand against the surface of the cooling element is, due to its dead weight, greater than the pressure at the side surfaces or at the upper side. Without such compensation, the heat center and thus the liquid core of the strand would be shifted out of its center toward the upper strand surface and the strand shell at the upper side of the strand would be of a lesser thickness than on its underside. As a result of the increase cooling capacity acting on the upper side of the strand according to the invention, a relatively larger heat dissipation is achieved there. The heat center is thereby shifted toward the underside of the strand into the geometric center of the strand, making it possible to attain the desired uniform thickness of the shell over the entire circumference of the strand.

By means of the apparatus of the invention and in particular with the use of the particular embodiment just described, it is possible to avoid heat stresses within the strand shell, which enhances the quality of the final product.

The individual cooling elements of the one or more aftercoolers of the invention are positioned by the adjusting devices to adapt to the conicity, or taper, of the cast strand subjected to cooling, with respect to the strand axis in the direction of the forward movement of the strand. In the event of varying conicity as a result of cast metal shrinkage properties changing within certain temperature ranges upon cooling, the system is designed to adapt to the changed conicity.

In light of the taper of the strand, it is advantageous to design the cooling areas of the cooling elements that come in sliding contact with the surface of the strand to be tapered in the direction of the strand travel. The aftercooler device is preferably subdivided into two to four aftercoolers and each aftercooler has preferably a number of cooling elements and cooling surfaces corresponding to the number of the individual circumferential surfaces forming the strand shell. The subdivision of the aftercooling device into a plurality of aftercoolers permits, as already mentioned above, an accurate adaptation of the position of the cooling elements to the strand as it changes in size as a result of the shrinkage.

To assist in achieving a strand shell of uniform thickness, the cooling elements, in particular cooling surfaces that contact the strand, are tapered in the downstream direction of the withdrawal of the strand, the surfaces decreasing in the dimension transverse of the strand axis. By thus applying the cooling effect only against the central areas close to the center of the individual surfaces of the strand shell and not against the strand edges or corners, a more uniform shell thickness is obtained. The strand edges themselves are subject to a certain amount of natural cooling and do not require all of the additional cooling provided by the cooling elements.

BRIEF DESCRIPTION OF THE DRAWINGS

The foregoing and other objects and features according to the invention are explained below in greater detail, with reference to the drawings, wherein.

Figure 2:
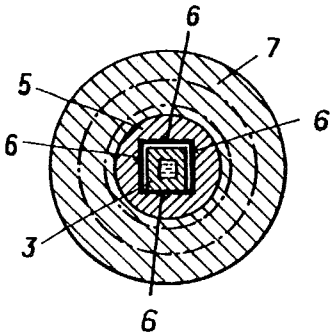
FIG. 2 PRIOR ART
FIG. 2 is a cross-section through the mold shown in FIG. 1, taken along the line II—II of FIG. 1, perpendicular to the mold axis.
Figure 1:
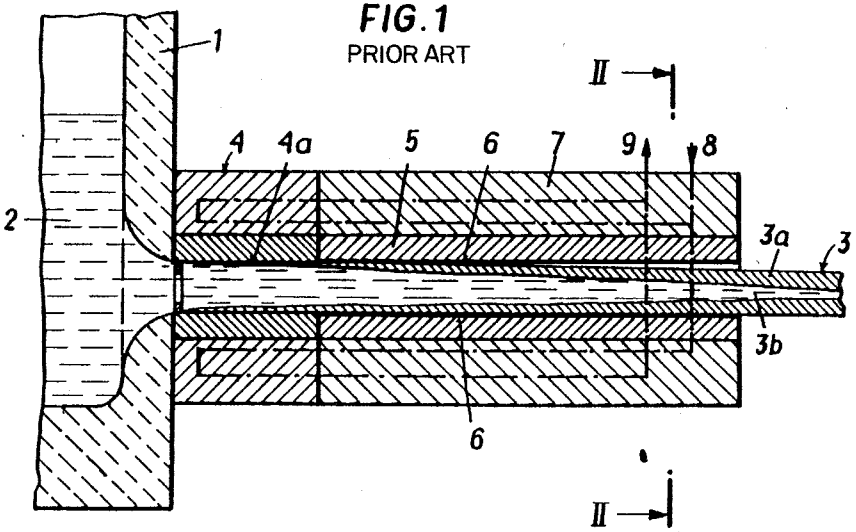
FIG. 1 PRIOR ART
FIG. 1 shows a longitudinal section through a conventional rigid continuous casting mold.

In the conventional rigid horizontal continuous casting plant illustrated in FIGS. 1 and 2, downstream of a molten metal container or melt distributor 1, made of refractory material, and containing a melt 2 of the metal to be cast, is a continuous casting mold 4 having a profiling surface 4*a* made of heat-conductive metal. The mold 4 is connected with a rigidly designed cooler 5 whose cooling surface 6, likewise made of heat conductive metal, comes into sliding contact with a strand 3 moving through the cooler. Tubular shell 7 supports the cooler 5.

Both the supporting shell 7 for the rigid cooler 5 and the mold 4 are traversed by a cooling medium which flows from an inlet 8 through a passage indicated by dash-dot lines to an outlet 9 and removes heat from the strand as it traverses the mold and the cooler. During the casting cycle, the melt 2 enters from the molten metal container into the cavity of the cooled mold 4 and starts to solidify there from the outside to form the strand 3. Within the mold, a shell 3*a* surrounding a liquid core 3*b* of the strand 3 is still thin and unstable. It gains continuously in thickness and strength in the direction of forward movement of the strand upon the passage of the strand 3 through the cooler 5 where the strand surface comes in contact with the cooling surfaces 6. Finally, upon leaving the cooler, the strand should be solidified to such a point that withdrawal or handling thereof can take place without any hazard of a break or the like.

The cooling and solidifying process occurring within the cooler 5 produces an overall shrinkage of the strand 3 and thus it is increasingly tapered in the direction of forward movement of the strand, i.e., from left to right in the drawing.

The rigid cooling surfaces 6 of the cooler 5 conventionally are arranged to be conically tapered in the direction of the strand travel so that the cooling surfaces 6 stay, as much as possible, in contact with the strand surface which itself is conical as a result of contraction, thereby to insure effective cooling of the strand as continuously as possible over the entire length of the cooler 5. However, the conicity of the rigid cooler, once it has been set, cannot be altered and can therefore not be adapted optimally to the differing shrinkage behavior of different metals or of alloys of varying composition. Substantial differences between the conicity of the strand and cooler can cause uneven solidification of the strand and could even result in the strand getting stuck in the cooler.

FIGS. 1 and 2 illustrate a typically occurring situation in the casting of a strand of rectangular cross-section where the degree of conicity of the aftercooler 5 is less than the shrinkage of the strand 3. The latter pulls away from the side and top surfaces of the cooler, but gravity keeps the bottom surface in contact with the cooler surface 6. It will be seen that this conventional arrangement will provide less cooling of the top and sides of the strand as it moves through the cooler.

For completeness' sake, it should be pointed out briefly that in a typical horizontal casting system, the strand 3 is drawn off continuously or in oscillating fashion by a withdrawal device (not shown), having for instance drive rolls, from the mold and the cooler, after which other desired operations, such as, e.g., cutting of the strand, storage, or the like take place.

Figure 3:
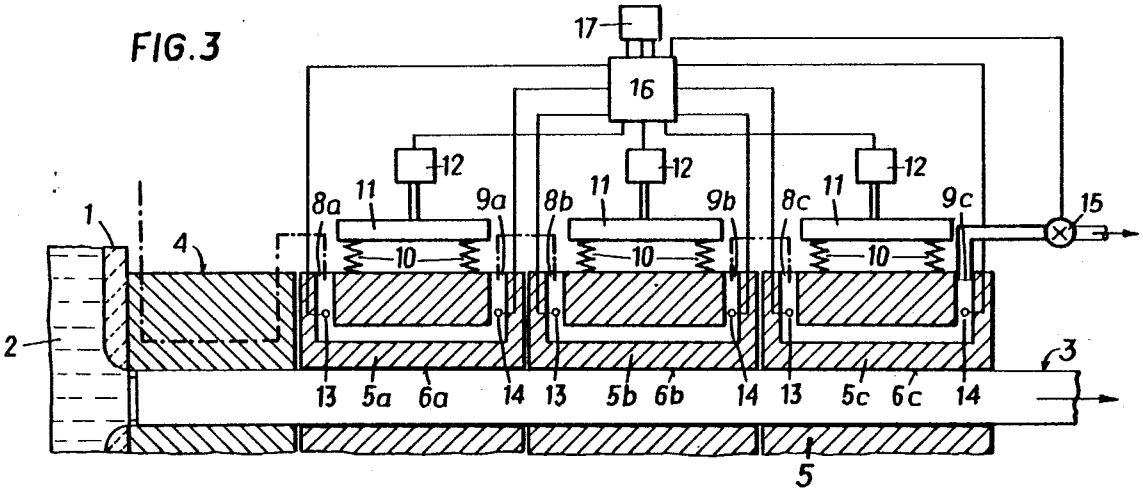
FIG. 3 is the schematic representation, in longitudinal cross-section, of a continuous casting facility illustrating the aftercooler of the invention with adjustable cooling elements.

FIG. 3 schematically illustrates cooling apparatus according to the invention with similar components having the same reference numerals as those used in FIGS. 1 and 2. The overall casting plant, insofar as the casting cycle itself is concerned, works in a manner similar to that described in connection with the mold 4 and FIGS. 1 and 2.

The cooling apparatus comprises three aftercoolers sequentially arranged in the downstream direction of the strand 3, immediately after the mold 4. Preferably, each of the aftercoolers includes a plurality of individual cooling elements 5*a*, 5*b*, 5*c*, arranged circumferentially around the strand, the respective cooling surfaces coming into contact with the strand on all sides.

A passage for the flow of a cooling medium extends through the mold 4 and the individual cooling elements 5*a*–5*c*. In the embodiment shown, the respective passages in the mold and the cooling elements are connected in series relationship, as indicated by the dash-dot lines connecting inlets 8*a*, 8*b*, 8*c* and outlets 9*a*, 9*b* and 9*c*. The flow of cooling medium may then occur in the direction of travel of the strand, after it has traversed the profiling mold 4. It should be pointed out that other arrangements for conducting the cooling medium through the cooling elements 5*a*–5*c* can be provided for. For example, the passages in the individual elements may be connected in parallel relationship or each cooling element may have its own independent cooling medium cycle.

The cooling elements 5*a*–5*c* are coupled by springs 10 to setting plates 11 and are variably adjustable toward and away from the strand axis. Through the elastic force of the springs, the cooling surfaces of cooling elements 5*a*–5*c*, may be movably forced onto the respective facing strand surfaces. The spring mounting enables the cooling surfaces to align automatically with the strand surfaces, rather than the strand axis, thereby achieving uniform cooling.

The setting plates 11 are adjusted towards and away from the strand by means 12 which preferably comprise digitally controllable DC stepping motors.

In the respective inlets 8*a*, 8*b*, and 8*c* and outlets 9*a*, 9*b*, and 9*c* for the cooling medium are disposed sensor devices indicated at 13 and 14 respectively. These sensor devices incorporate temperature measurement sensors, such as thermocouple elements and may also include flow rate sensors. In the series connections of flow passages shown, a single sensor 15 may be provided for the measurement of the quantity of cooling medium, usually water, traversing the cooling elements 5*a*–5*c*. The temperature and flow characteristics determined by the sensors 13, 14, and 15 are fed to a computer 16 that processes the data to give an indication of resultant heat dissipation actually occurring and compares that data with theoretically determined data corresponding in to the specific metal being cast which previously had been entered into data storage means 17.

The sensing elements 13, 14, and 15, the data storage means 17, the computer 16 and the setting means 12 comprise a servo system for maintaining the heat dissipation actually obtained substantially equal to a theoretical derived reference value. When deviations between the measured and theoretical values occur, the computer 16 issues appropriate instructions, e.g. in the form of pulses, to the stepping motors of the setting devices 12, which move towards or away from the strand, depending on the direction of the deviation. The new position of the cooling element is maintained for the setting plates 11 and thus the cooling elements 5*a*, 5*b*, and 5*c*, period of time required for the value of heat dissipation determined by the computer 16 from the data supplied by the sensors 13–15 to come into conformity with the stored, desired values of the heat dissipation, for each one of the named cooling elements.

Alternatively, or concurrently with the adjustment of the position of the cooling elements, the output of computer 16 may be employed to vary the flow rate of the cooling medium through the passages in the cooling element. This may be accomplished by applying the digital output of the computer to D.C. stepping motors for controlling valves (not shown) in the flow path. In the case of series-connected flow passages, as shown in FIG. 3, a single such valve may be used. If separate control of flow in each cooling element is desired, individual valves may be provided for each element.

Figure 4:
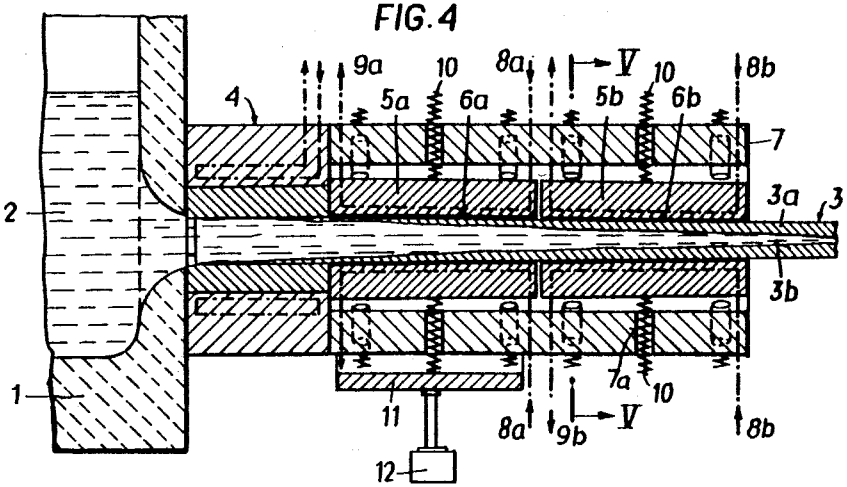
FIG. 4 is a longitudinal section through apparatus according to the invention having two aftercoolers.
Figure 5:
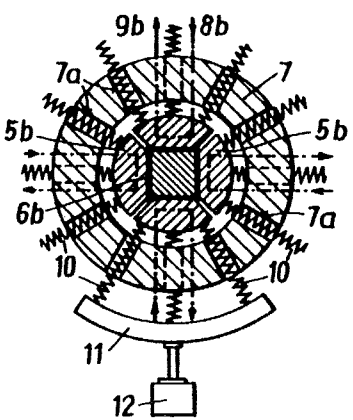
FIG. 5 is a cross-section through the apparatus shown in FIG. 4, taken along the line V—V perpendicular to the longitudinal axis.
Figure 6:
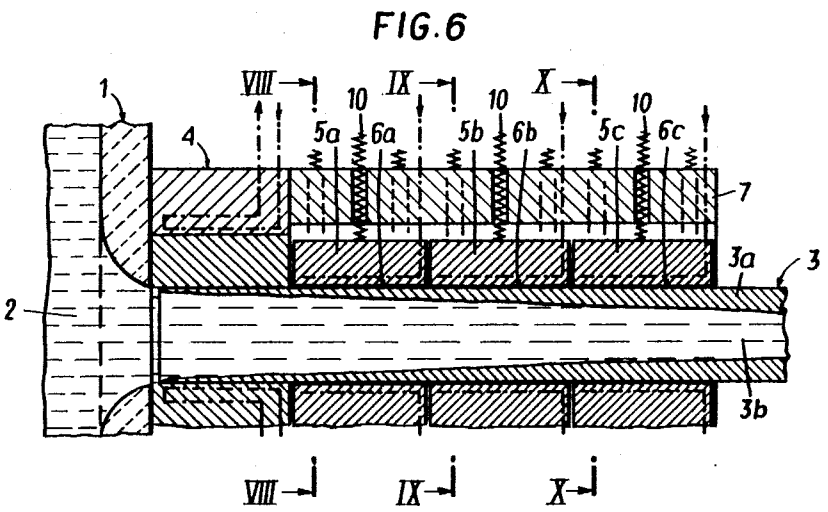
FIG. 6 is a longitudinal section through apparatus according to the invention with three individual aftercoolers.

Another embodiment of apparatus according to the invention is shown in FIGS. 4 and 5, in which the basic elements of the plant correspond to the plant schematically illustrated in FIG. 3. Corresponding parts are designated by the same reference numerals.

The aftercooling apparatus of FIGS. 4 and 5 comprises two aftercoolers, respective cooling elements 5*a*, 5*b* of which are arranged around the circumference of the strand 3 and have their cooling surfaces 6*a*, 6*b* in sliding contact with the strand. A single tubular shell 7 surrounds both sets of cooling elements. The shell 7 has openings 7*a* through which are arranged contact springs 10 that urge the various cooling elements 5*a*, 5*b* against the individual surfaces of the strand 3.

The flow passages for the cooling medium are indicated by dash-dot lines and include inlets 8*a*, 8*b* and outlets 9*a*, 9*b* in the respective cooling elements. It will be understood that temperature and flow rate sensors, as described in connection with the embodiment of FIG. 3, are provided in the flow passages, along with the servo control system.

In the arrangment of FIGS. 4 and 5, the device for adjusting the contact pressure for each of the cooling elements, which are schematically shown on only one cooling element, includes the arcuate setting plate 11 and the setting means 12, which comprises a DC stepping motor, and are arranged outside the tubular shell 7 so that they are relatively unaffected by heat.

From FIG. 4, it is apparent that the cooling elements 5*a*, 5*b* are, with respect to the tubular shell 7, arranged to converge in the direction of travel of the strand, the resilient spring means 10 enabling the cooling elements to adapt themselves to the conicity occurring as a result of the shrinkage of the strand 3. The precise setting of the contact pressure is controlled, in response to the amount of heat dissipated, through loading or releasing of the springs 10 by the setting plate 11 which is adjustable in position by the setting means 12.

FIGS. 6 to 10 show a continuous casting plant similar to FIGS. 4 and 5 in which the aftercooling apparatus 5 is subdivided into three aftercoolers 5*a*, 5*b*, and 5*c*, reference numerals being the same in FIGS. 6 to 10 for corresponding elements in FIGS. 4 and 5.

Figure 7:
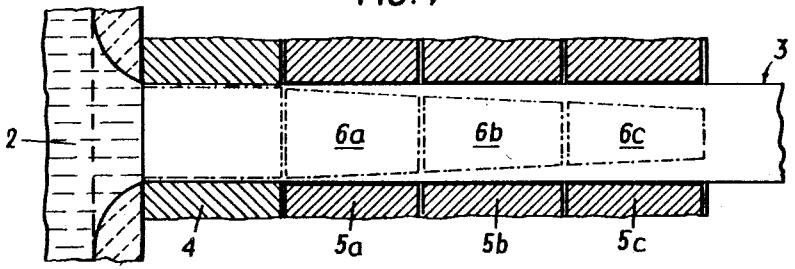
FIG. 7 is a schematic top view showing the cooling surfaces of the aftercooler elements projected onto the strand surface.
Figure 8:
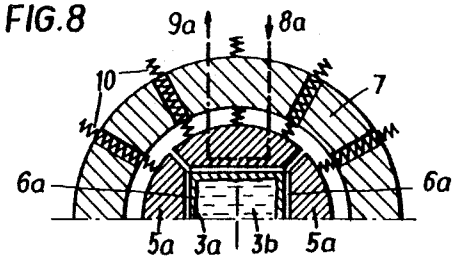
FIGS. 8, 9 and 10 are cross-sections through the apparatus of FIG. 6 taken along the lines VIII—VIII, IX—IX and X—X, respectively, perpendicular to the longitudinal axis.
Figure 9:
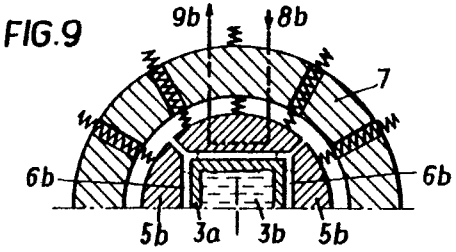
Figure 10:
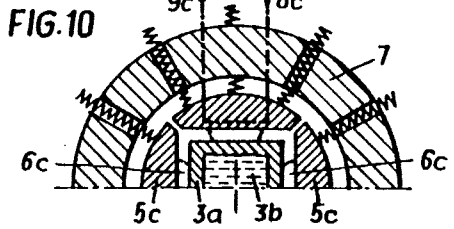

FIG. 7 illustrates schematically the embodiment of the invention in which the cooling surfaces 6*a*–6*c* of the cooling elements, 5*a*–5*c* that are in contact with the strand are continuously reduced in width transverse to the direction of travel of the strand, being widest at the beginning of the first aftercooler.

As the widths of the cooling surfaces decrease, edges of the strand 3 are removed from the forced cooling, thereby avoiding excessively intensive cooling that might cause undesirable "thickening" of the strand shell, and inhomogeneities, e.g., cracks in the product.

While the invention has been described with reference to preferred embodiments thereof, it will be understood by those skilled in the art that various changes in form and details thereof may be made without departing from the spirit and scope of the invention.

I claim:

1. For use with apparatus for horizontal continuous casting of metals and alloys, particularly steels, which includes a container for molten metals and a horizontally oriented mold for profiling a cast strand, said strand being drawn through the mold during casting, aftercooler means for said strand adapted to be disposed downstream of said mold, said aftercooler means comprising:

at least one cooling element adapted to be positioned in contact with the surface of the strand, said cooling element having a passage therethrough for the flow of a fluid cooling medium, position adjusting means for positioning said cooling element in contact with said strand and for varying the contact pressure of said cooling element against said strand, means for varying the rate of flow of cooling medium through said passage, means for measuring the amount of heat dissipated from the strand into said cooling medium as it flows through said cooling element, and means responsive to the amount of heat dissipated from the strand into said cooling medium for selectively controlling one or both of said position adjusting means and flow rate varying means to maintain a desired rate of cooling of said strand.

2. The aftercooler means of claim 1 wherein a plurality of said cooling elements are disposed circumferentially about said strand along a given length of the path of said strand, each of said cooling elements adapted to be individually positioned in contact with the surface of said strand and having a passage therethrough for the flow of a fluid cooling medium.

3. The aftercooler means of claim 2 wherein successive sets of said pluralities of cooling elements are arranged sequentially along said strand path.

4. The aftercooler means of claims 1, 2 or 3 wherein said means for controlling said position adjusting means and said flow rate varying means comprises:

means for storing heat dissipation data corresponding to a desired rate of cooling of said strand, means for comparing the measured heat dissipation from said strand with said stored data, and means responsive to a difference between said stored data and said measured heat dissipation for selectively actuating one or both of said position adjusting means and said flow rate varying means to bring said measured heat dissipation to equal the heat dissipation represented by said stored data.

5. The aftercooler means of claims 1, 2 or 3 wherein said means for measuring the amount of heat dissipated from said strand comprises temperature sensors at the inlets and outlets of each of the passages through the respective elements and means for measuring the rate of flow of cooling medium through said passages.

6. The aftercooler means of claim 3 wherein the fluid flow passages, in corresponding cooling elements of the sequential sets of cooling elements are connected in series relationship.

7. The aftercooler means of claim 4 wherein said means for actuating said position adjusting means comprises a direct current stepping motor.

8. The aftercooler means of claim 4 wherein said control means separately controls said position adjusting means and said flow rate varying means of said cooling elements, whereby cooling elements disposed above a longitudinally extending horizontal median plane through the strand may be controlled to effect more heat dissipation from the strand than cooling elements disposed below said plane.

9. The aftercooler means of claims 1, 2 or 3 wherein the cooling surfaces of said cooling elements in contact with said strand are tapered in the direction of travel of said strand.

10. The aftercooler means of claim 9 wherein the cooling surfaces of said cooling elements in contact with said strand taper in dimension transverse of the direction of travel of said strand, being wider at the upstream ends of said cooling elements than at the downstream ends.

* * * * *